US010180054B2

(12) United States Patent
Chen et al.

(10) Patent No.: US 10,180,054 B2
(45) **Date of Patent: *Jan. 15, 2019**

(54) USING RADIO WAVES TO FRACTURE ROCKS IN A HYDROCARBON RESERVOIR

(71) Applicant: Saudi Arabian Oil Company, Dhahran (SA)

(72) Inventors: Jinhong Chen, Katy, TX (US); Daniel T. Georgi, Houston, TX (US); Hui-Hai Liu, Katy, TX (US); Lorne Arthur Davis, Jr., Seguin, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/891,117

(22) Filed: Feb. 7, 2018

(65) Prior Publication Data

US 2018/0163525 A1 Jun. 14, 2018

Related U.S. Application Data

(63) Continuation of application No. 15/243,312, filed on Aug. 22, 2016, now Pat. No. 9,896,919.

(51) Int. Cl.
*E21B 43/26* (2006.01)
*E21B 49/00* (2006.01)

(52) U.S. Cl.
CPC ..... *E21B 43/26* (2013.01); *E21B 49/00* (2013.01)

(58) Field of Classification Search
CPC ..... E21B 43/26; E21B 49/00
USPC ..... 166/248
See application file for complete search history.

(56) References Cited

U.S. PATENT DOCUMENTS

| | | | | |
|---|---|---|---|---|
| 4,135,579 | A | 1/1979 | Rowland et al. | |
| 4,193,451 | A * | 3/1980 | Dauphine | E21B 43/17 166/248 |
| RE30,738 | E | 9/1981 | Bridges et al. | |
| 4,345,650 | A * | 8/1982 | Wesley | E21B 36/04 166/177.2 |
| 4,485,869 | A | 12/1984 | Sresty | |
| 6,012,520 | A | 1/2000 | Yu et al. | |
| 7,828,057 | B2 | 11/2010 | Kearl et al. | |
| 8,646,524 | B2 | 2/2014 | Al-Buriak | |

(Continued)

OTHER PUBLICATIONS

U.S. Appl. No. 14/715,149, filed May 18, 2015, Unpublished, Al-Buriak et al.

(Continued)

*Primary Examiner* — Silvana C Runyan
(74) *Attorney, Agent, or Firm* — Fish & Richardson P.C.

(57) ABSTRACT

The present disclosure describes methods and systems for fracturing geological formations in a hydrocarbon reservoir. One method includes forming a borehole in a hydrocarbon reservoir from a surface of the hydrocarbon reservoir extending downward into the hydrocarbon reservoir; transmitting an electromagnetic (EM) wave through the borehole: directing at least a portion of the EM wave to rocks at a location below the surface in the hydrocarbon reservoir; and fracturing the rocks at the location below the surface in the hydrocarbon reservoir by irradiating the rocks around the borehole using at least the portion of the EM wave, wherein irradiating the rocks elevates pore-water pressure in the rocks causing fracturing of the rocks.

18 Claims, 10 Drawing Sheets

(56) References Cited

U.S. PATENT DOCUMENTS

| | | | | |
|---|---|---|---|---|
| 8,701,760 | B2 | 4/2014 | Parsche | |
| 8,701,770 | B2 | 4/2014 | Schultz | |
| 8,877,041 | B2 | 11/2014 | Parsche | |
| 2011/0108277 | A1 | 5/2011 | Dudley et al. | |
| 2012/0061081 | A1 | 3/2012 | Sultenfuss et al. | |
| 2012/0318498 | A1* | 12/2012 | Parsche | E21B 43/14 166/248 |
| 2014/0014327 | A1 | 1/2014 | Badri et al. | |
| 2014/0225607 | A1 | 8/2014 | Edwards | |
| 2014/0239956 | A1 | 8/2014 | Hoversten | |
| 2015/0103624 | A1 | 4/2015 | Thompson | |
| 2015/0167439 | A1 | 6/2015 | Kasevich et al. | |
| 2015/0167440 | A1* | 6/2015 | Kasevich | E21B 33/124 166/52 |
| 2015/0192005 | A1* | 7/2015 | Saeedfar | E21B 36/00 166/248 |

OTHER PUBLICATIONS

U.S. Appl. No. 14/715,149, filed May 18, 2015, Al-Buriak et al.

Cooper et al, "The effect of Cracks on the Thermal Expansion of Rocks," Earth and Planetary Science Letters, vol. 36, No. 3 (1977) 404-412, Department of Earth and Planetary Sciences, Massachusetts Institute of Technology, Cambridge, Massachusetts; Elsevier Scientific Publishing Company, Amsterdam.

Chen et al, "Fracturing Tight Rocks by Elevated Pore-Water Pressure Using Microwaving and its Applications," SPWLA 56th Annual Logging Symposium, Jul. 18-22, 2015, Long Beach, California, USA.

Chen et al, "Assessing Tensile Strength of Unconventional Tight Rocks Using Microwaving," Unconventional Resources Technology Conference, Jul. 20-22, 2015, San Antonio, Texas, USA.

International Search Report and Written Opinion issued in International Application No. PCT/US2017/047072 dated Nov. 10, 2017; 12 pages.

* cited by examiner

210

$K_m = \infty$ Mpsi
$K_m$ = 16 Mpsi
$K_m$ = 12 Mpsi
$K_m$ = 8 Mpsi
$K_m$ = 4 Mpsi
WATER PRESSURE (kpsi)
14
13
12
11
10
9
8
140
145
150
155
160
TEMPERATURE (°C)

220

USING RADIO WAVES TO FRACTURE ROCKS IN A HYDROCARBON RESERVOIR

CROSS-REFERENCE TO RELATED APPLICATIONS

This application is a continuation application of and claims the benefit of priority to U.S. application Ser. No. 15/243,312, filed on Aug. 22, 2016, the contents of which are hereby incorporated by reference.

TECHNICAL FIELD

This disclosure relates to fracturing geological formations in a hydrocarbon reservoir, for example, using electromagnetic waves.

BACKGROUND

In some cases, a reservoir may have a tight geologic formation. The tight geologic formation can include rocks with a low permeability. Flows of hydrocarbon fluids can be limited in regions where the rocks have a tight formation. It may be difficult to recover the hydrocarbon products in these types of reservoirs.

In some cases, hydraulic fracture techniques can be used to fracture a tight geologic formation. In a hydraulic fracture method, large quantity of hydraulic fluid can be pumped underground to fracture the rocks and to keep open the fractured rocks. The hydraulic fluid can include a mixture of water, proppants (for example, sand or other proppants), and chemicals.

SUMMARY

The present disclosure describes methods and systems for using radio waves to fracture rocks in a reservoir. One method includes forming a borehole in a hydrocarbon reservoir from a surface of the hydrocarbon reservoir extending downward into the hydrocarbon reservoir; transmitting an electromagnetic (EM) wave through the borehole: directing at least a portion of the EM wave to rocks at a location below the surface in the hydrocarbon reservoir; and fracturing the rocks at the location below the surface in the hydrocarbon reservoir by irradiating the rocks around the borehole using at least the portion of the EM wave, wherein irradiating the rocks elevates pore-water pressure in the rocks causing fracturing of the rocks.

The foregoing and other implementations can each, optionally, include one or more of the following features, alone or in combination:

A first aspect, combinable with the general implementation, wherein the borehole is a first borehole, and wherein the method further comprises forming, in the hydrocarbon reservoir, a borehole pattern comprising a plurality of boreholes including the first borehole; and for each of the plurality of boreholes, fracturing rocks around the borehole using the radio wave that elevates pore-water pressure in the rocks.

A second aspect, combinable with any of the previous aspects, wherein the plurality of boreholes are formed in a vertical well pattern.

A third aspect, combinable with any of the previous aspects, wherein the plurality of boreholes are formed in a horizontal well pattern.

A fourth aspect, combinable with any of the previous aspects, wherein forming, in the hydrocarbon reservoir, the borehole pattern comprising: determining a fracturing radius based on a diameter of the borehole and a stimulated fracture density; and positioning the plurality of boreholes in the borehole pattern based on the fracturing radius.

A fifth aspect, combinable with any of the previous aspects, wherein the borehole pattern is a 5-spot pattern.

A sixth aspect, combinable with any of the previous aspects, wherein the radio wave has a frequency between 500 KHz and 5 MHz.

A seventh aspect, combinable with any of the previous aspects, wherein the rocks have a permeability between about 1 nanodarcy (nD) and 0.01 millidarcy (mD).

An eighth aspect, combinable with any of the previous aspects, wherein the method further comprises: positioning an EM wave transmitter at a surface of the reservoir; and generating the EM wave using the EM wave transmitter.

A ninth aspect, combinable with any of the previous aspects, wherein the method further comprises: positioning an EM wave transmitter in the borehole, wherein the EM wave transmitter is enclosed in a protective case; generating the EM wave using the EM wave transmitter; and retrieving the EM wave transmitter after the rocks are fractured.

A tenth aspect, combinable with any of the previous aspects, wherein the location is a first location and the EM wave is a first EM wave. The method further comprises: transmitting a second EM wave through the borehole; directing at least a portion of the second EM wave to rocks at a second location below the surface in the hydrocarbon reservoir; and fracturing the rocks at the second location below the surface in the hydrocarbon reservoir by irradiating the rocks around the borehole using at least the portion of the second EM wave, wherein irradiating the rocks elevates pore-water pressure in the rocks causing fracturing of the rocks, and a distance between the first location and the second location is determined based on a penetration depth of the first EM wave.

Another method includes forming a borehole pattern comprising a plurality of boreholes in a hydrocarbon reservoir from a surface of the hydrocarbon reservoir extending downward into the hydrocarbon reservoir; transmitting an EM wave through at least one of the plurality of boreholes; and for each of the at least one of the plurality of boreholes, fracturing rocks around the respective borehole using the EM wave.

The foregoing and other implementations can each, optionally, include one or more of the following features, alone or in combination:

A first aspect, combinable with the general implementation, wherein the plurality of boreholes are formed in a vertical well pattern.

A second aspect, combinable with any of the previous aspects, wherein the plurality of boreholes are formed in a horizontal well pattern.

A third aspect, combinable with any of the previous aspects, wherein an azimuthal coverage of a stimulation zone generated by the EM wave for each of the plurality of boreholes is a fraction of a circumference of the respective borehole.

A fourth aspect, combinable with any of the previous aspects, wherein a radiation pattern generated by the EM wave for each of the at least one of the plurality of boreholes is azimuthally asymmetric with respect to the respective borehole.

A fifth aspect, combinable with any of the previous aspects, wherein the method comprises: determining a distance based on a stimulated fracture density; and positioning the plurality of boreholes in a pattern having an equal distance between neighboring boreholes, wherein the equal distance is set to the determined distance.

A sixth aspect, combinable with any of the previous aspects, wherein the method comprises: positioning an EM wave transmitter at a surface of the reservoir; and generating the EM wave using the EM wave transmitter.

A seventh aspect, combinable with any of the previous aspects, wherein the method comprises: positioning an EM wave transmitter in at least one of the plurality of the boreholes, wherein the EM wave transmitter is enclosed in a protective case; generating the EM wave using the EM wave transmitter; and retrieving the EM wave transmitter after the rocks are fractured.

Yet another method includes forming a borehole in a hydrocarbon reservoir from a surface of the hydrocarbon reservoir extending downward into the hydrocarbon reservoir; generating an EM wave that fractures rocks in the hydrocarbon reservoir; transmitting the EM wave through the borehole; and fracturing rocks at a location below the surface in the hydrocarbon reservoir by irradiating the rocks around the borehole using the EM wave, wherein the rocks have a permeability between about 1 nanodarcy (nD) nD and 0.01 millidarcy (mD) and irradiating the rocks elevates pore-water pressure in the rocks causing fracturing of the rocks.

Other implementations of this aspect include corresponding systems and apparatuses.

The details of one or more implementations of the subject matter of this disclosure are set forth in the accompanying drawings and the description below. Other features, aspects, and advantages of the subject matter will become apparent from the description, the drawings, and the claims.

DESCRIPTION OF DRAWINGS

Like reference numbers and designations in the various drawings indicate like elements.

DETAILED DESCRIPTION

Figure 1A:
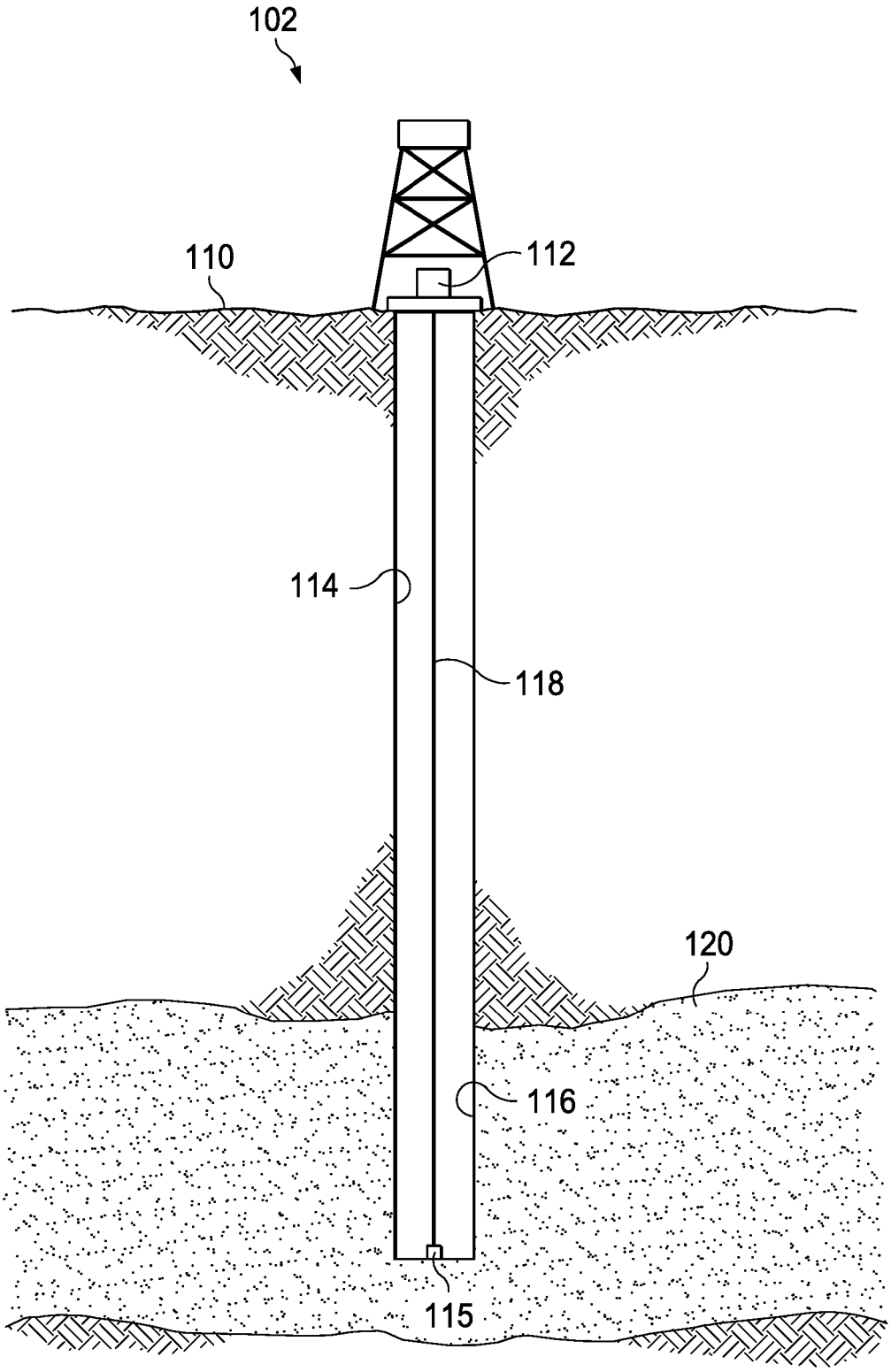
FIG. 1A is a schematic diagram that illustrates an example well system including a vertical borehole according to an implementation.

This disclosure generally describes methods and systems for fracturing rocks in a hydrocarbon reservoir. In some cases, a reservoir may have tight geographic formations between wells. Flows of hydrocarbon fluids can be very limited in regions where the rocks have a tight formation. In some cases, the rocks in the regions of a tight formation may have a low permeability. Examples of a low permeability can include matrix permeability between less than 1 nanodarcy (nD) and 0.01 millidarcy (mD). Examples of rocks having a low permeability include shales, tight sandstones, and tight carbonates. Therefore, if a region of a reservoir has a tight formation, it may be difficult to recover the hydrocarbon products, for example, oil or gas, from the region. In some cases, hydraulic fracturing can be used to fracture the rocks and improve permeability. However, using hydraulic fracturing to recover hydrocarbon products may have one or more disadvantages. For example, hydraulic fracturing may use a significant amount of water. Furthermore, the hydrocarbon recovery rate using hydraulic fracturing can be less than 10% for oil and less than 35% for gas. Hydraulic fracturing can also induce damage to the fracture surface and impede flow from the formation to the fractures. Moreover, it may be difficult to control the location of the fracturing zone. In addition, the recovered fluid from hydraulic fracturing may create environment issues and thus may need to be disposed of or treated.

In some cases, heat transfer can be used to increase the fluidity of the oil in geological formations with a high permeability. In one example, microwave can be used to increase the temperature of the wellbore or a heating device in a well. Because microwave has a high intensity, the temperature of the wellbore or the heating device can be raised to a high level, for example, to a level as high as 700 F. The heat can be transferred from the wellbore or the heating device to the oil in the subterranean formation around the well. The heat can break down the chemical structure of the oil and decrease the viscosity of the oil. If the subterranean formation has a high permeability, for example, if the rocks around the well have a loose formation, this approach can make it easier for the oil to flow from one well to another well. However, using this approach to fracture rocks with a tight formation may have one or more issues. For example, microwave has a short wavelength, and therefore may have a low penetration depth.

In a subterranean structure with a tight geological formation, pore-water pressure can increase rapidly when the pore-water in the rocks is heated. In the context of this disclosure, pore-water pressure refers to the pressure of connate water held in gaps between particles within a soil or rock. In some cases, rocks in a tight formation can be fractured by increasing the pore-water pressure. In some implementations, electromagnetic (EM) waves with long wavelength can be used to irradiate directly on the rocks around a borehole. Examples of the EM waves with long wavelength can include a radio wave. In some cases, radio waves having a frequency between 500 kilohertz (KHz) to 5 megahertz (MHz) can be used to irradiate the rocks and heat the pore water in the rocks. When the water temperature is increased to a sufficiently high level, the pore-water pressure can fracture the rocks. Alternatively or additionally, EM waves with even higher frequency, for example, up to 100 MHz, can be used to irradiate the rocks.

In some cases, this approach can provide a mechanism to fracture rocks without using fracturing fluids. The mechanism can increase rock permeability in the tight formation and increase recovery rate in the reservoir. In addition, this approach can introduce minimum formation damages by redistributing the fractured rocks in the borehole. Furthermore, patterns of the boreholes can be selected to optimize the size of the total stimulation zone, and thus the size of the stimulated zone can be well controlled. Moreover, this approach can work in deep reservoir with strong rocks, for which hydraulic fracturing may not be practical. In addition, this approach does not introduce chemicals in the process and therefore can be more environmental friendly.

Figure 1B:
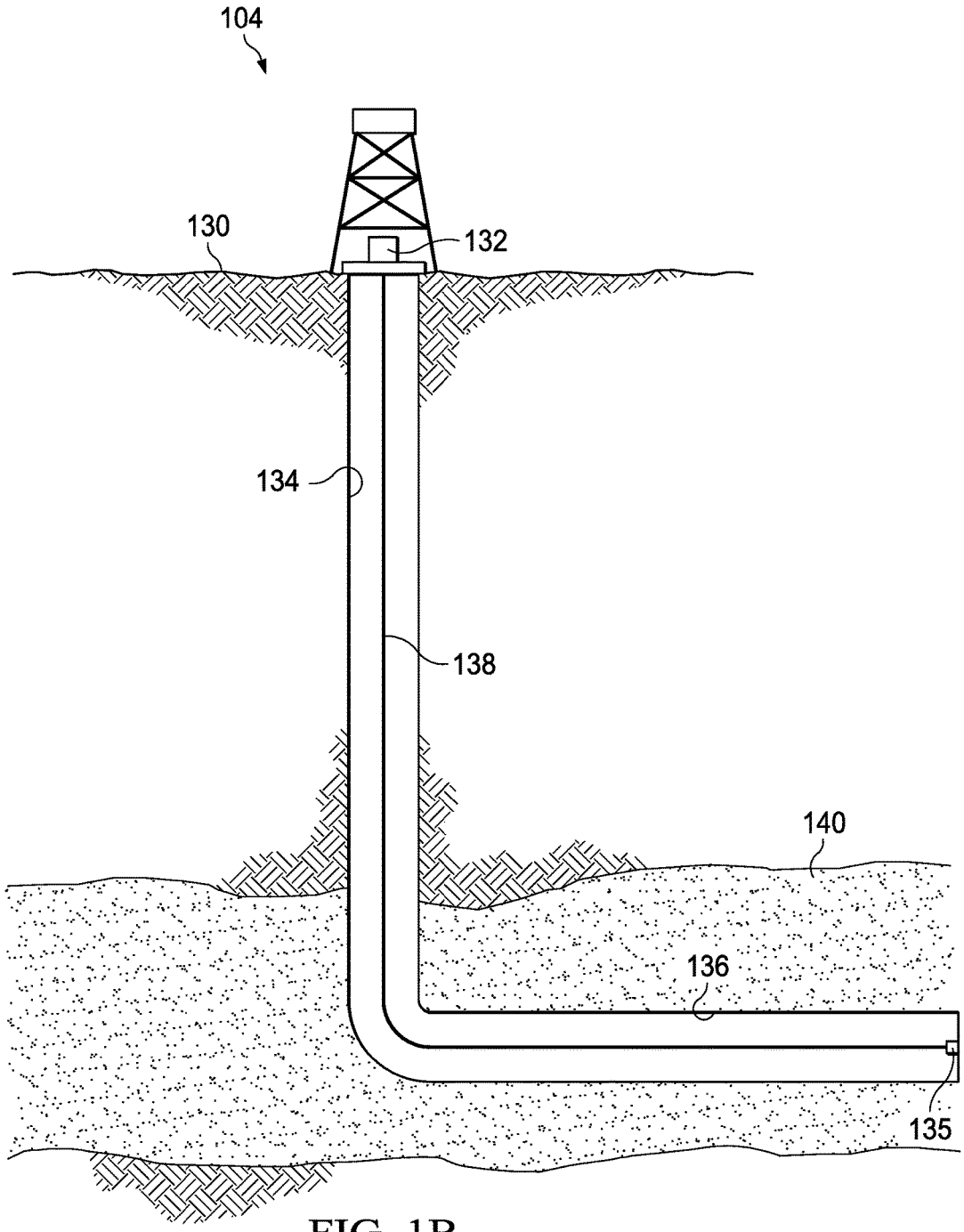
FIG. 1B is a schematic diagram that illustrates an example well system including a horizontal borehole according to an implementation.

FIGS. 1A and 1B are schematic diagrams that illustrate example well systems 102 and 104, respectively, according to respective implementations. The example well systems 102 and 104 can use EM waves to irradiate rocks and fracture rocks around a wellbore, as described below.

Figure 2A:
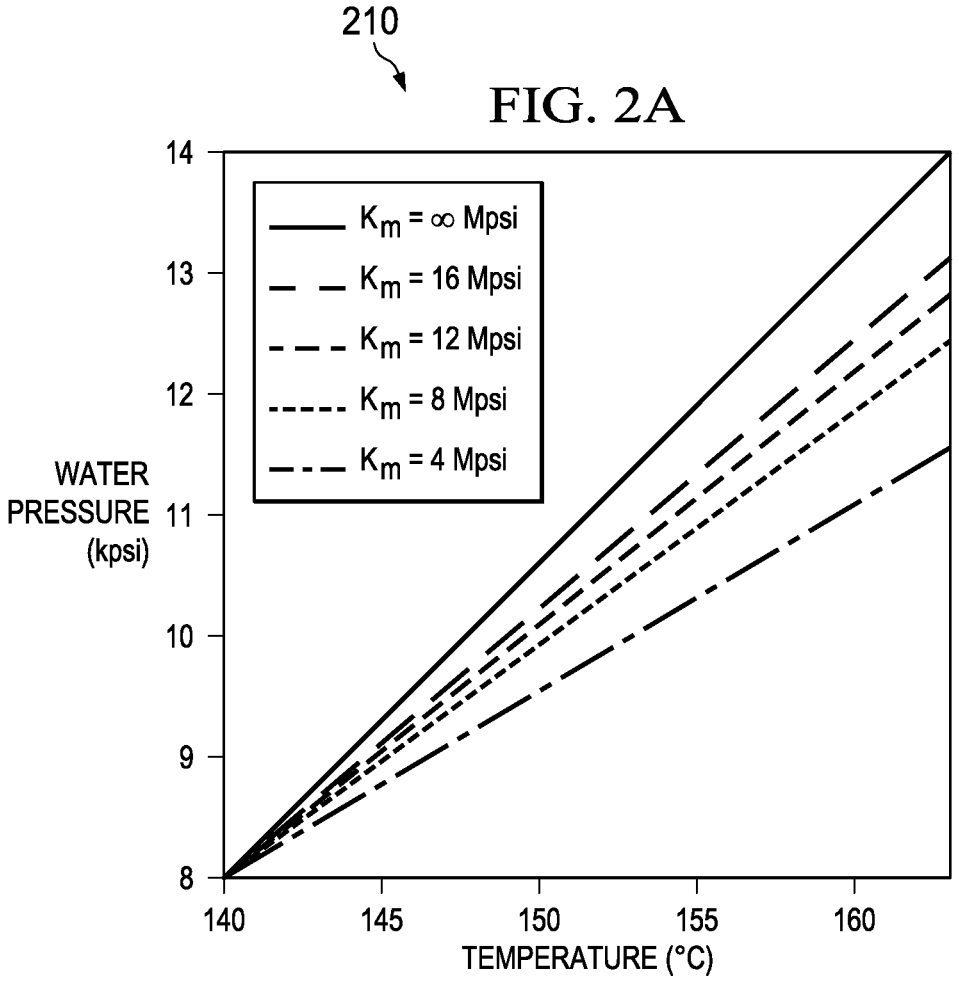
FIG. 2A is a chart illustrating relationships between pore-water pressure and temperature changes according to an implementation.

In some cases, changes in the pore-water pressure can depend on the water content, rock matrix modulus, temperature changes, or a combination thereof, in the reservoir rocks. FIG. 2A is a chart 210 illustrating relationships between pore-water pressure and temperature changes, according to an implementation. In some cases, the rocks can be fractured if the pore-water pressure is equal to, or larger than, a summation of the minimum in-situ effective stress and the rock tensile strength of the rocks. In some cases, for rocks from tight formations, rocks may be fractured when pore-water pressure reaches a few thousand pounds per square inch (psi). The chart 210 shows the pore-water pressure elevations for 10% water in the rocks with different matrix modulus. As shown in FIG. 2A, if the temperature is increased by 20 degrees Celcius, the pore-water pressure can be increased to about 10,000 psi or higher. In these cases, the increase of the pore-water pressure may pulverize the rocks into small fragments, and thus fracture the rocks and increase the permeability.

In some cases, the penetration depth of an EM wave into a rock formation can be a function of the wavelength of the EM wave and the dielectric property of the rock formation. Microwave has a wavelength of approximately 12 cm, and thus may not be used to efficiently stimulate formations much more beyond 12 cm. On the other hand, EM waves with longer wavelength than microwaves, for example, radio waves, can provide much longer penetration depth than microwaves. For example, radio waves having frequency in the MHz range can penetrate several dozen feet from a borehole into the rocks around the borehole, and thus stimulate a much larger volume of tight rocks for production in a single well.

In some cases, the average power generated from an EM wave can be represented in the equation (1):

$$P_{av} = \frac{1}{2}\omega\varepsilon_0 \sum_i \int_V \varepsilon''_{r,i} E \cdot E^* dV \tag{1}$$

where $P_{av}$ represents the average power, ω represents the EM frequency, E represents the electric field strength, E* represents the conjugate of E, $\varepsilon''_{r,i}$ represents the relative dielectric loss of the ith mineral composition including the fluids, and $\varepsilon_0$ represents a constant coefficient that is equal to $8.85\times10^{-12}$ F/m.

As shown in equation (1), the average power can be calculated by integrating over the volume the EM wave irradiates. The volume of that the EM wave irradiates depends on the penetration depth of the EM wave. Equation (2) represents an example calculation of the penetration depth:

$$D = \frac{\lambda}{2\pi}\{2\varepsilon'_r[1 + (\varepsilon''_r/\varepsilon'_r)^2]^{1/2} - 1\}^{-1/2} \tag{2}$$

where D represents the penetration depth, λ represents the wavelength of the EM wave, $\varepsilon_r'$ and $\varepsilon_r''$ represent the average relative dielectric constant and dielectric loss of the rock formation, respectively. The term $\varepsilon_r''$ can be a function of the dielectric loss $\varepsilon''_{dl}$ and the conductivity σ, which can be represented as $\sigma=1/\rho$, where ρ represents the formation resistivity. Equation (3) represents an example calculation of the dielectric loss $\varepsilon_r''$:

$$\varepsilon'' = \varepsilon''_{dl} + \frac{\sigma}{2\pi\nu\varepsilon_0} \tag{3}$$

where ν represents the EM frequency and $\nu=c/\lambda$, $c=3\times10^8$ m/s, and $\varepsilon_0=8.854\times10^{-12}$ F/m.

Figure 2B:
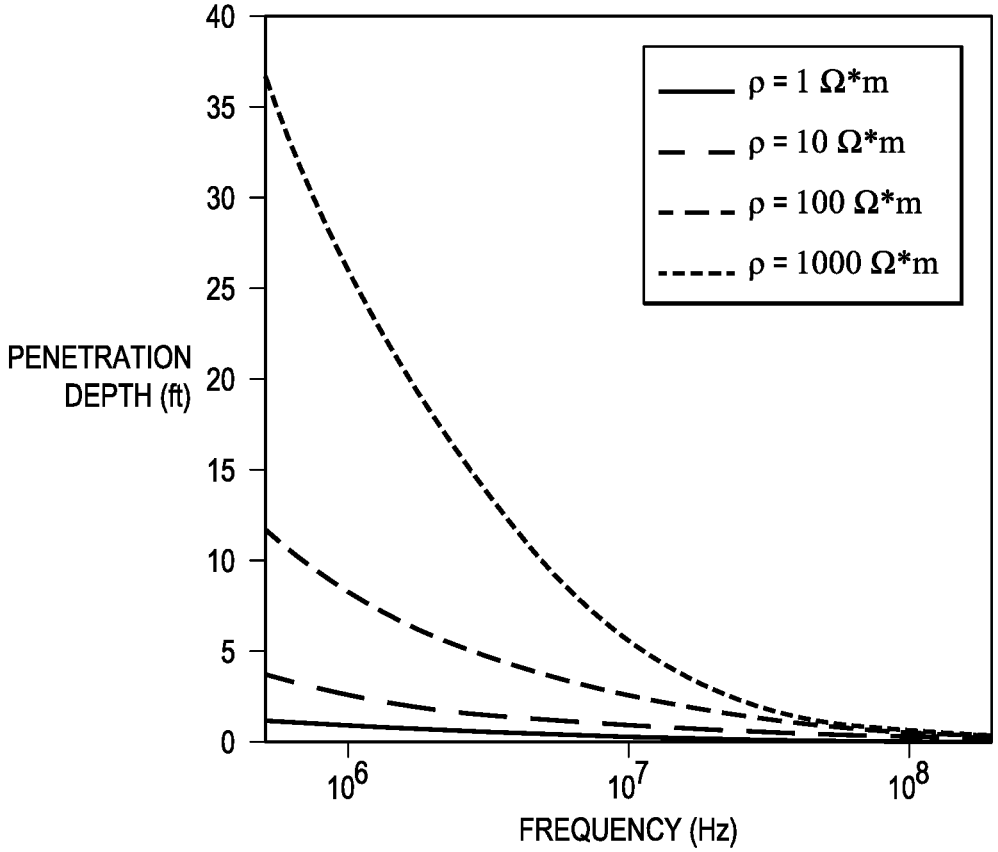
FIG. 2B is a chart illustrating an example relationship between the frequency and the penetration depth of the EM wave according to an implementation.

FIG. 2B is a chart 220 illustrating an example relationship between the frequency and the penetration depth of the EM wave according to an implementation. In the illustrate example, $\varepsilon_i''$ is set to 4 and $\varepsilon''_{dl}$ is set to 0.3. The chart 220 illustrates the peneration depth as a function of the EM wave frequency for different resistivities of the formation. The resisitivity of a production shale formation can be between 100 Ω·m and 1000 Ω·m. Therefore, using an EM wave in the range of 500 KHz to 5 MHz can provide a peneration depth of several feet. Alternatively or additionally, EM waves with higher frequency, for example, up to 100 MHz, can be used to irradiate the rocks As shown in equation (2) and FIG. 2B, the penetration depth depends on the wavelength of the EM wave and the property of the rock formation. In the context of the present disclosure, a stimulation zone refers to the region of rocks that are affected by the EM wave. In some cases, the depth of the stimulation zone can be larger than the penetration depth due to the thermal conductivity. In some implementations, the depth of the stimulated zone can be a few dozens of feet. As shown in Eq. (1), the heating efficiency of the formation can depend on the square of the field intesnity E of the EM wave.

Returning to FIG. 1A, the example well system 102 includes a wellbore 114 below the terranean surface 110. The wellbore 114 is extended by a vertical borehole 116 in the tight rock formation region 120. The tight rock formation can span a single formation, portions of a formation or multiple formations.

The well system 102 also includes an EM wave transmitter 112. The EM wave transmitter 112 can be implemented as one or more hardware circuit elements, software, or a combination thereof that can be configured to generate an EM wave. In some implementations, an EM wave transmitter, for example, the EM wave transmitter 112, can include a power supply, an oscillator, a modulator, a power amplifier, or any combinations thereof, that can be configured to generate EM waves to irradiate the rock formation. In some implementations, the transmitter can include a synthesized radio frequency (RF) signal generator, a free running RF signal generator, or a combination thereof The well system 102 also includes an antenna 115. The antenna 115 can be positioned in the vertical borehole 116.

The antenna 115 can be configured to transmit radio waves into in the tight rock formation surrounding the vertical borehole 116. The antenna 115 can be implemented using dipole antenna.

The well system 102 also includes a transmission line 118 that is coupled with the EM wave transmitter 112 and the antenna 115. The transmission line can be configured to direct the EM wave generated by the EM wave transmitter 112 to the antenna 115. The transmission line 118 can be implemented using a coaxial cable, a twisted pair wire, or a waveguide. In some implementations, a waveguide can be implemented using hollow conductive metal pipes.

In operation, the EM wave transmitter 112 generates EM waves. The EM waves can travel through the transmission line 118 to the antenna 115. The antenna 115 irradiates EM waves to the rocks around the vertical borehole 116. The irradiation raises the temperature of the water and rocks around the vertical borehole 116 and increases the pore-water pressure in the rocks. The increased pore-water pressure fractures the rocks. The fractured rocks around the vertical borehole 116 can become loose. Some of the loosed rocks can collapse into the vertical borehole 116. Rocks collapsing into the vertical borehole 116 can cause restructuring of the rocks and create a corresponding increase in the permeability of the rocks. The hydrocarbon products, for example, oil or gas, in the tight rock formation region 120 can then be recovered through the wellbore 114.

In some cases, a horizontal borehole can be used instead of the vertical borehole. As shown in FIG. 1B, the example well system 104 includes a wellbore 134 below the terranean surface 130. The wellbore 134 is extended by a horizontal borehole 136 in the tight rock formation region 140. The well system 104 also includes an EM wave transmitter 132, a transmission line 138, and an antenna 135.

In operation, the EM wave transmitter 132 generates EM waves that travel through the transmission line 138 to the antenna 135. The antenna 135 irradiates EM waves to the rocks around the horizontal borehole 136. The irradiation raises the temperature of the rocks around the horizontal borehole 136 and increases the pore-water pressure in the rocks around the horizontal borehole 136. In some cases, the irradiation is targeted to the stimulation zone above the horizontal borehole 136. The increased pore-water pressure fractures the rocks. The fractured rocks can become loose. Some of the loosed rocks can collapse into the horizontal borehole 136. Rocks collapsing into the horizontal borehole 136 can cause restructuring of the rocks and creates a corresponding increase in the permeability of the rocks. The hydrocarbon products, for example, oil or gas, in the tight rock formation region 140 can then be recovered through the wellbore 134.

Figure 1C:
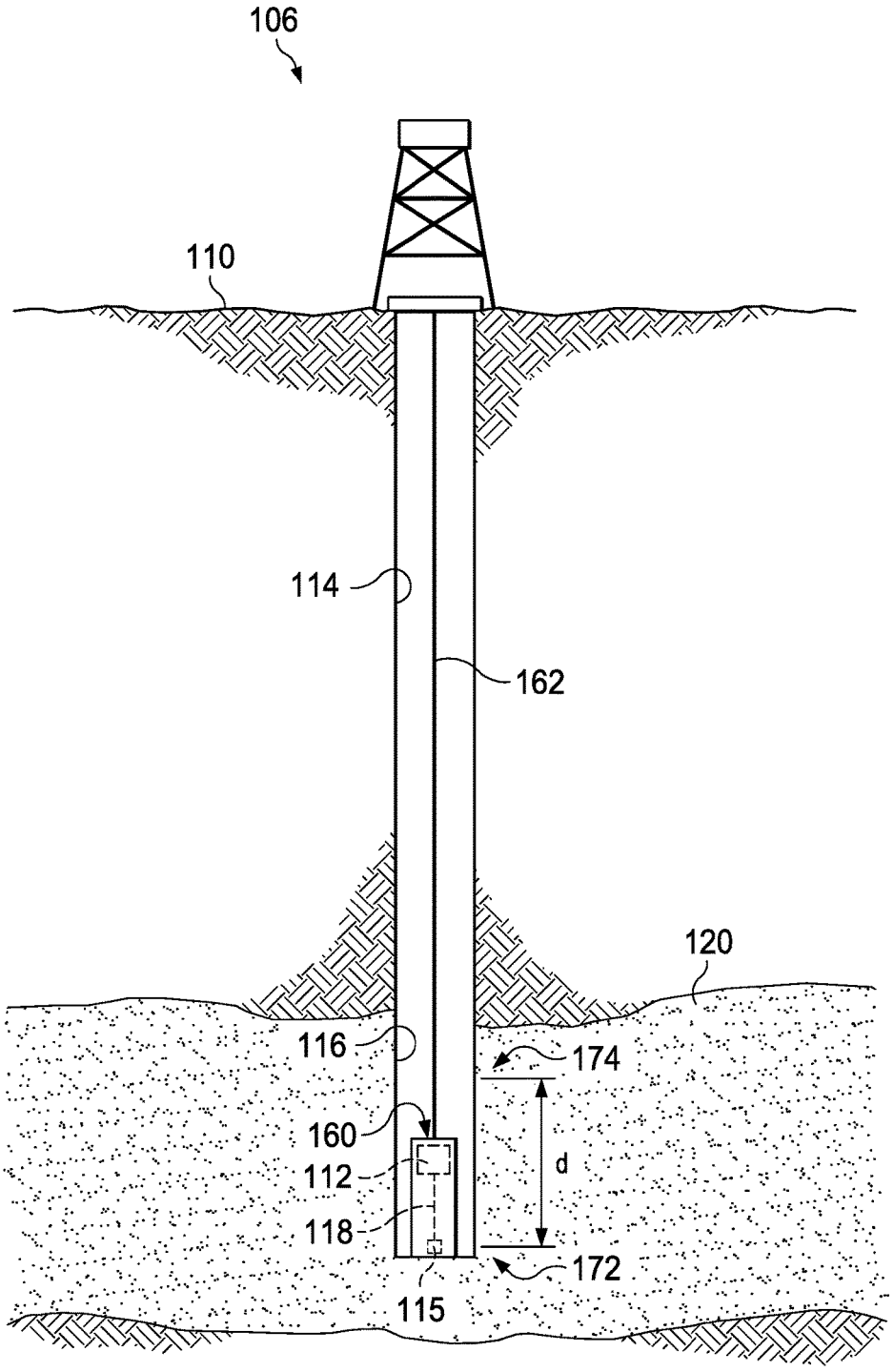
FIG. 1C is a schematic diagram that illustrates an example well system including an EM wave transmitter below the surface according to an implementation.

In some cases, as illustrated in FIGS. 1A and 1B, the EM wave transmitter can be positioned at the surface. Alternatively or in combination, the EM wave transmitter can be positioned inside the borehole. FIG. 1C is a schematic diagram that illustrates an example well system 106 including an EM wave transmitter below the surface according to an implementation. As shown in FIG. 1C, the EM wave transmitter 112 is placed inside the vertical borehole 116 in the tight rock formation region 120. In some cases, a case 160 can be used to protect the EM wave transmitter 112, the transmission line 118, the antenna 115, or any combinations thereof, from the collapsed rocks. The case 160 can be implemented using a ceramic conduit. In some cases, a cable 162 can be used to retrieve the case 160 after the rocks are irradiated and fractured to reuse the components protected by the case 160.

In some cases, the irradiation can be performed in stages. For example, in a first stage irradiation, the antenna 115 can be positioned at a first location 172. The antenna 115 can irradiate rocks surrounding the first location 172. After the first stage irradiation, the antenna 115 can be repositioned at a second location 174 to irradiate the rocks around the second location 172. The distance between the first location 172 and the second 174 can be determined based on the penetration depth of the EM waves, as discussed previously in FIG. 2B and associated descriptions. This process can be repeated for additional stages of irradiation.

Figure 3:
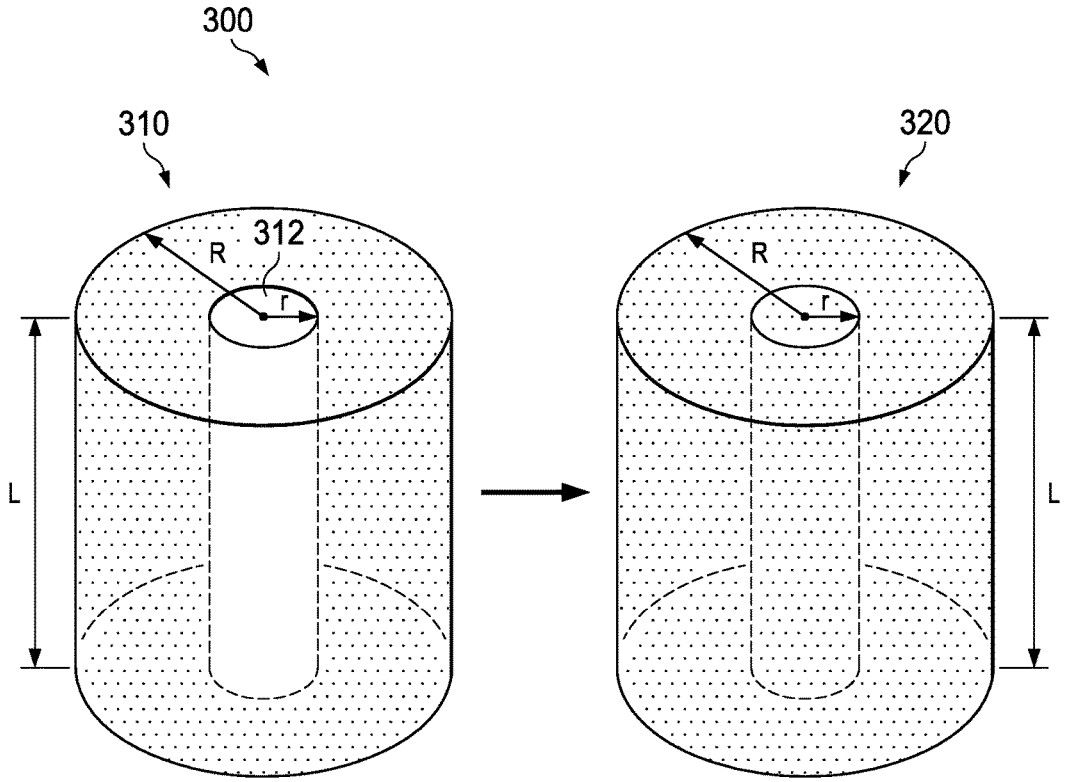
FIG. 3 is a schematic diagram that illustrates volume distributions of fractured rocks according to an implementation.

FIG. 3 is a schematic diagram 300 that illustrates volume distributions due to EM wave irradiation, according to an implementation. The schematic diagram 300 includes a illustration of stimulation zones 310 and 320, respectively. The stimulation zone 310 represents the formation before the irradiation. As shown in FIG. 3, the stimulation zone 310 includes a borehole 312 that is drilled into the stimulation zone 310. In the illustrated example, the stimulation zone 310 has a length L and a radius R. The borehole 312 has a radius r. As discussed previously, during irradation, while the radio wave travels through the borehole 312, the radio wave irradiates the rocks around borehole 312, which includes the rocks in the stimulation zone 310. The stimulation zone 320 represents the formation after the irradiation. The stimulation zone 320 has the same length L and the same radius R as the stimulation zone 310. After irradiation, the fractured rocks in the stimulation zone 310 fall into the borehole 312 due to gravity.

Assuming the fractures are homogeneously distributed in the stimulated zone 320 and the stimulated fracture density is a (the fraction of fracture volume over the stimulated volume), equation (3) represents the volume redistributions in the stimulation zones 310 and 320 by the fractured rocks:

$$\pi r^2 \cdot L = \alpha \pi R^2 \cdot L \text{ Or } R = d/(2\sqrt{\alpha}) \quad (3)$$

where d represents the diameter of the borehole 312 and d=2r. In some cases, when the stimulated fracture density $\alpha$ is 0.1%, the permeability can increase approximately 3 orders of magnitude. This would significantly enhance hydrocarbon production in rocks with tight formations. In some cases, for a 6 inch borehole, the radius of the stimulated zone can be approximately 8 ft. For a 24 inch borehole, the radius of the stimulated zone can be extended to more than 60 ft. Furthermore, if there is any original void space in the formation other than the drilled borehole, the stimulated zone or the fracture density can be further increased. To use the EM energy for stimulation efficiently, the penetration depth D of the EM in Eq. (2) can be optimized to approximately equal to the stimulated zone size R in Eq. (3). In some cases, the size of the borehole can be determined based on a target radius of the stimulation zone and a targeted stimulated fracture density using equation (3).

When the borehole is positioned horizontally, the gravity and the elevated pore-water pressure can redistribute the rock fragments into the horizontal borehole. In some cases, it may be beneficial to fracture a portion of the formation above the borehole, and therefore the rocks above the borehole can be redistributed into the borehole under gravity. For example, instead of transmitting the EM wave in an omni-direction orientation, the antenna 135 can be configured to transmit EM waves above the horizontal borehole 136. Therefore, the azimuthal coverage of the stimulation zone can include a fraction of the circumference of the horizontal borehole 136.

In some cases, the stimulated zone can be significantly increased by using multiple boreholes. This approach may increase efficiency because drilling multiple sidetrack wells can be relatively cheap. For example, the patterned boreholes can be drilled using sidetracking and can share one vertical wellbore.

Figure 4A:
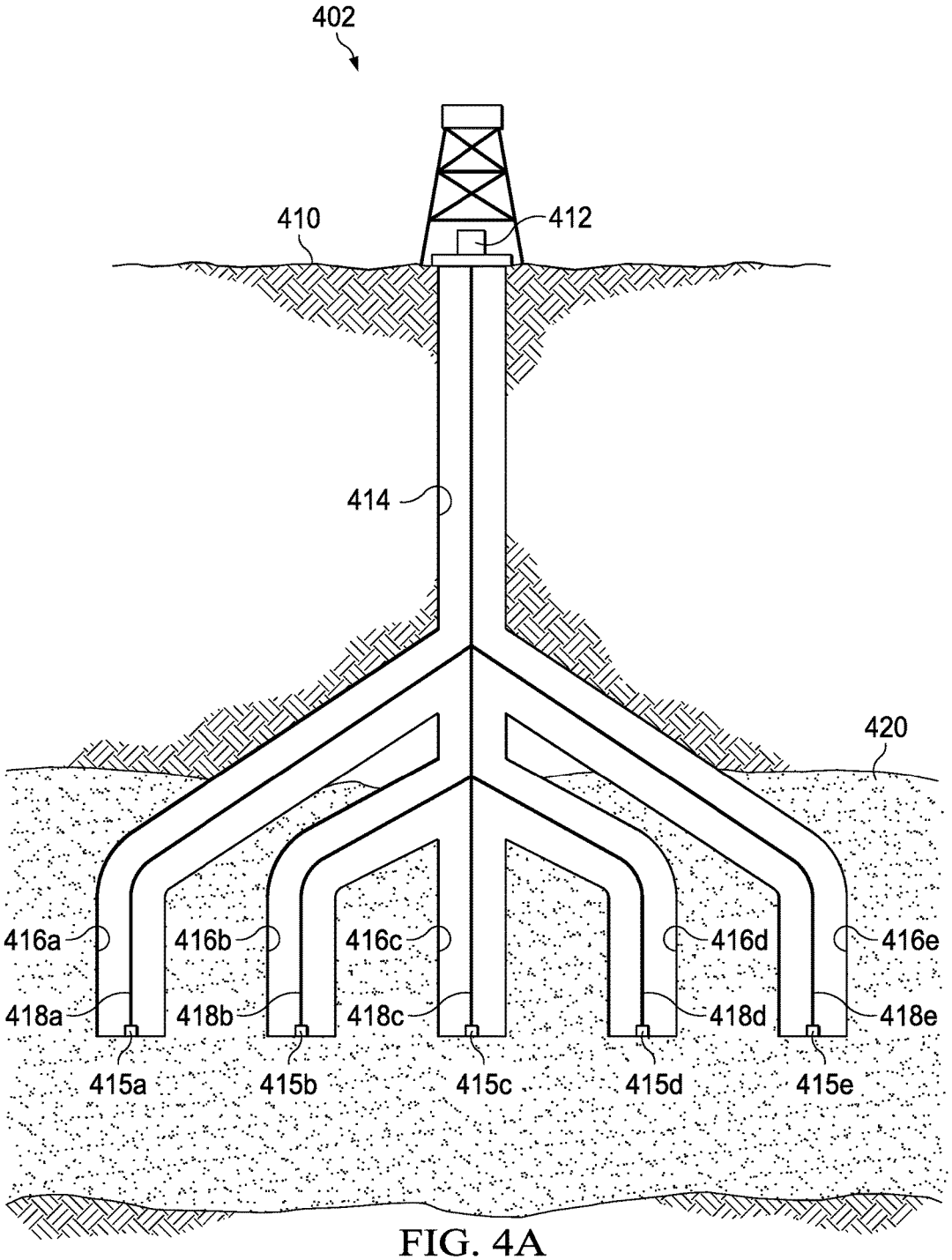
FIG. 4A is a schematic diagram that illustrates an example well system including multiple vertical boreholes according to an implementation.
Figure 4B:
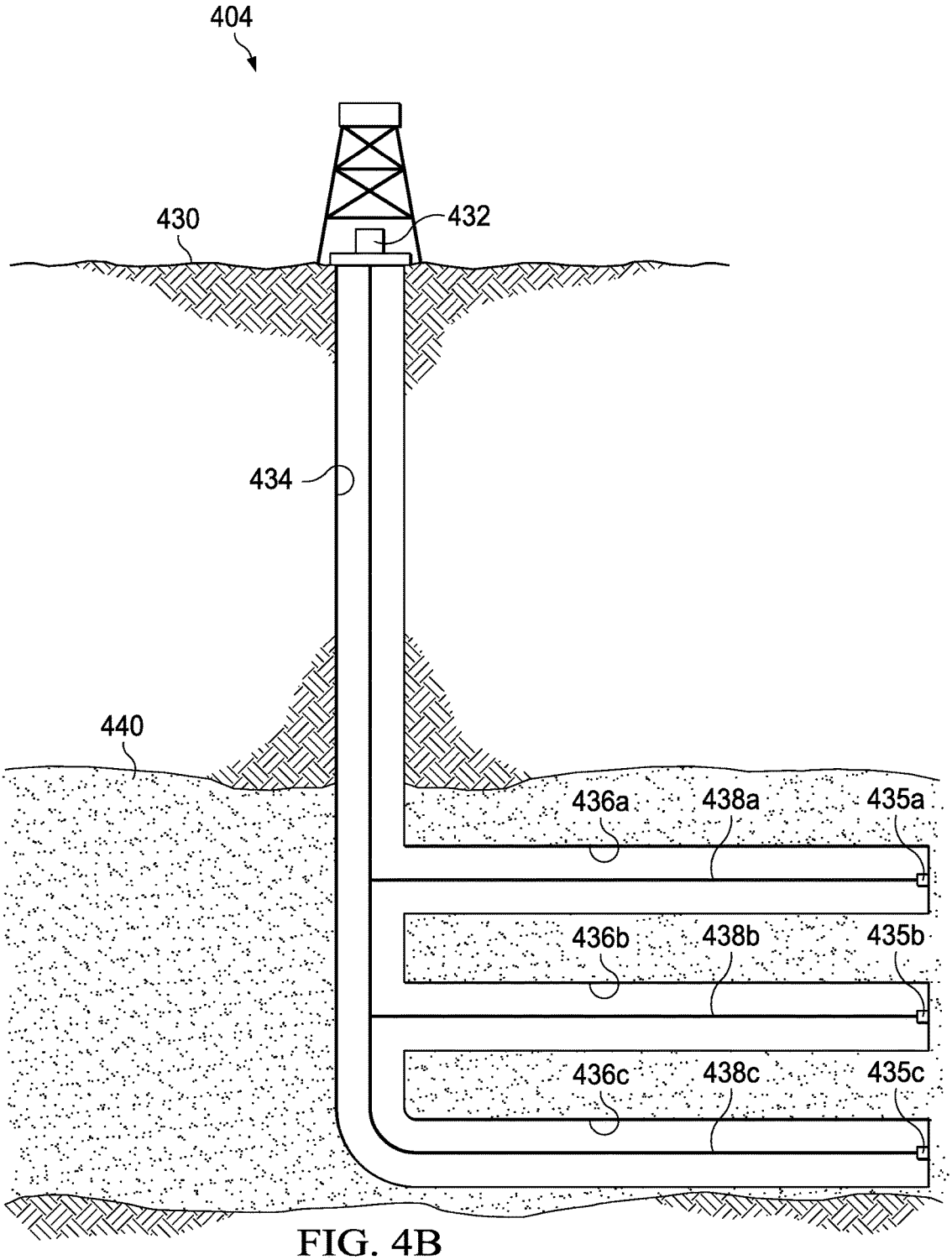
FIG. 4B is a schematic diagram that illustrates an example well system including a plurality of horizontal boreholes according to an implementation.

FIGS. 4A and 4B are schematic diagrams that illustrate example well systems 402 and 404, respectively, according to an implementation. The example well systems 402 and 404 can include multiple boreholes. As shown in FIG. 4A, the example well system 402 includes a wellbore 414 below the terranean surface 410. The wellbore 414 is extended by multiple vertical boreholes 416*a-e* in the tight rock formation region 420. The well system 402 also includes an EM wave transmitter 412 and transmission lines 418*a-e* that connect the EM wave transmitter 412 with antennas 415*a-e*, respectively. In operation, the EM wave transmitter 412 generates EM waves that are directed through each of the multiple boreholes 416*a-e* to the antennas 415*a-e* using the transmission lines 418*a-e*. The antennas 415*a-e* transmit the EM waves to irradiate the rocks around the boreholes 416*a-e* and fracture the rocks around the boreholes 416*a-e* with increased pore-water pressure.

In some cases, the multiple boreholes 416*a-e* can form a pattern. In some implementations, the pattern can be selected to optimize the size of the total stimulation zone for a given number of boreholes. For example, a 5-spot pattern can be selected to position the multiple boreholes 416*a-e*. In a 5-spot pattern, the distances between a central borehole, for example, the borehole 416*c*, and each of the surrounding boreholes, for example, the boreholes 416*a*, 416*b*, 416*d*, and 416*e* are the same. As discussed previously, the radius of the stimulation zone introduced by one borehole can be determined based on the stimulated fracture density and penetration depth of the EM wave. Therefore, the distance between the central borehole and a surrounding borehole can be determined based on the radius of the stimulation zone. For example, the distance between the central borehole and a surrounding borehole can be set to 2 times the determined radius. Thus, the size of the total simulation zone can be optimized if the size of the borehole pattern is set according to the calculation described previously.

Figure 4C:
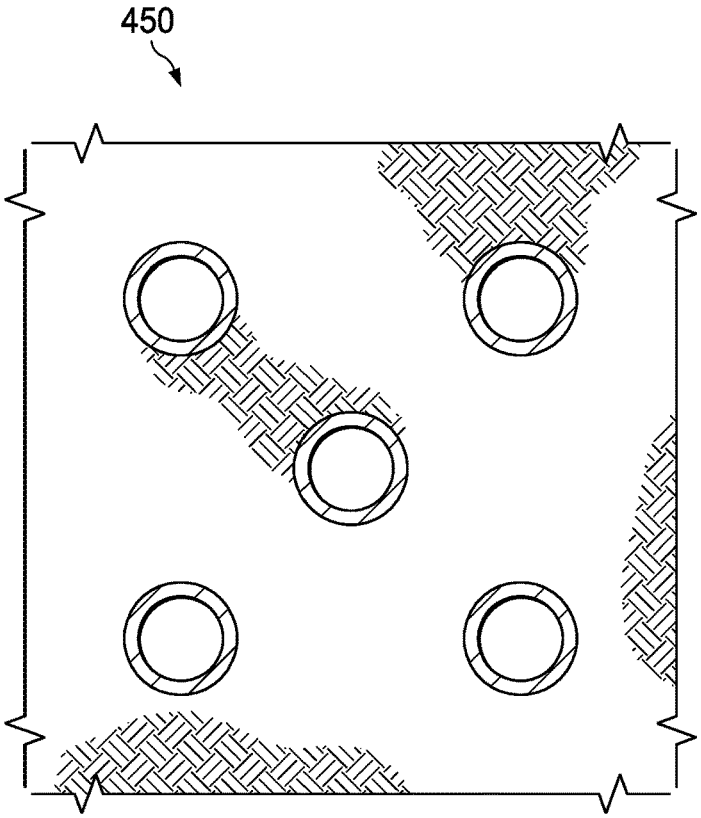
FIG. 4C illustrates a top view of an example pattern of borehole formations according to an implementation.

FIG. 4C illustrates a top view 450 of an example pattern of borehole formations according to an implementation. As illustrated, the example pattern is a 5 spot pattern, where each surrounding borehole is positioned with the same distance relative to a central borehole. This pattern can provide an optimized coverage because the pattern covers a large stimulated zone with a small number of boreholes, and therefore saves drilling cost. This pattern can also be repeated easily to cover a portion of a reservoir or the entire reservoir.

In some cases, as discussed previously, horizontal boreholes can be used instead of the vertical boreholes. As shown in FIG. 4B, the example well system 404 includes a wellbore 434, below the terranean surface 430. The wellbore 434 is extended by multiple horizontal boreholes 436*a-c* in the tight rock formation region 440. The well system 404 also includes an EM wave transmitter 432 and transmission lines 438*a-c* that connect the EM wave transmitter 432 with antennas 435*a-c*, respectively. In operation, the EM wave transmitter 432 generates EM waves that are directed through each of the multiple boreholes 436*a-c*, using the transmission lines 438*a-c*. The antennas 435*a-c* transmit the EM waves to irradiate the rocks around the boreholes 436*a-c* and fracture the rocks around the boreholes 436 with increased pore-water pressure.

Figure 4D:
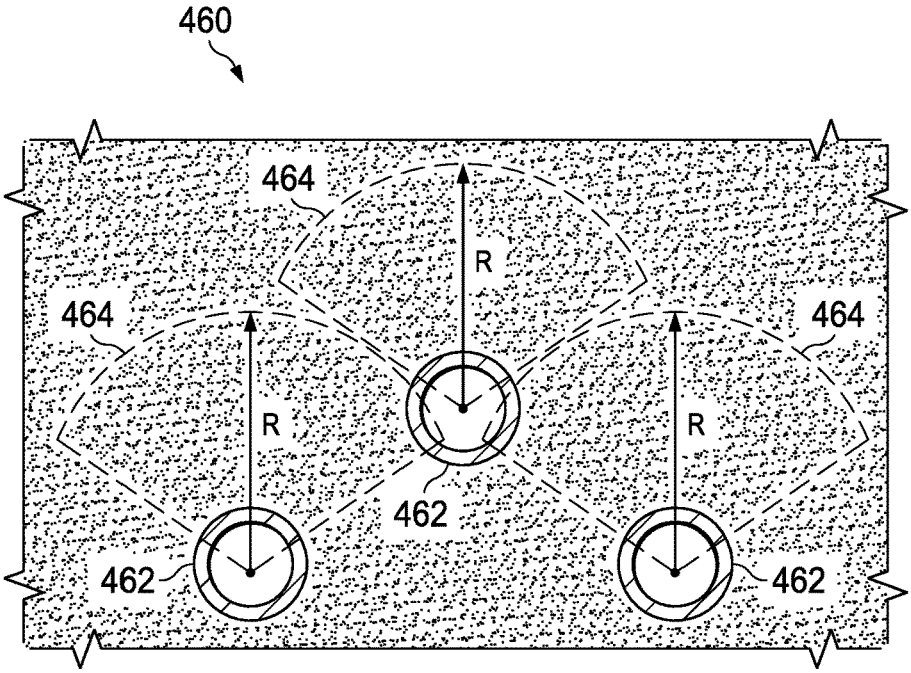
FIG. 4D illustrates a side view of an example pattern of borehole formations according to an implementation.

In some cases, a pattern of equal distance between neighboring boreholes can be selected. In some cases, the fractured rocks above a horizontal borehole are redistributed into the horizontal boreholes. In these or other cases, the distance between the boreholes can be set close to the determined radius. FIG. 4D illustrates a side view 460 of an example pattern of borehole formations according to an implementation. The side view 460 includes multiple horizontal boreholes 462. For each horizontal borehole 462, the EM waves can be targeted to the rocks above the horizontal borehole 462. The rocks in regions 464 above the horizontal borehole 462 are redistributed during fracturing. The distances between neighboring horizontal boreholes 462 are set to R, which is the radius of the stimulation zone.

As discussed previously, the horizontal borehole can be tilted towards a fracture direction to generate a radiation pattern that is azimuthally asymmetric with respect to the borehole. For example, the horizontal borehole may be tilted by an angle relative to the vertical wellbore. Consequently, the size of the stimulated zone can be represented by equation (4):

$$R = \sqrt{\frac{\pi}{2\alpha\theta}} \cdot d \tag{4}$$

where θ represents the angle of the fractured zone above the borehole. In some cases, θ can be set to 100 to 110 degrees.

In some cases, while multiple boreholes are formed, one or more boreholes among the multiple boreholes are used for irradiation. The rocks around the one or more boreholes can be fractured by the EM waves. The remaining boreholes can be used for future irradiation in a later stage. This approach may be more economical than drilling boreholes in different stages. In one example, every other borehole can be used for irradiation in the first stage. The high attenuation caused by the connate water may trigger a second stage of irradiation. During the second stage, one or more of the remaining boreholes can be used for irradiation.

In some cases, during the first stage, the presence of the unused boreholes can affect the stress distributions and result in local stress concentrations that can deflect the EM wave-induced fractures. In these or other cases, a temperature survey or a Distributed temperature sensing (DTS) system can be used to measure the temperature at locations around unused boreholes to determine whether the EM waves have penetrated to these locations. If the temperature does not rise to a threshold, the EM waves have not penetrated to these locations, and irraditions from the unused boreholes can be performed.

Figure 5:
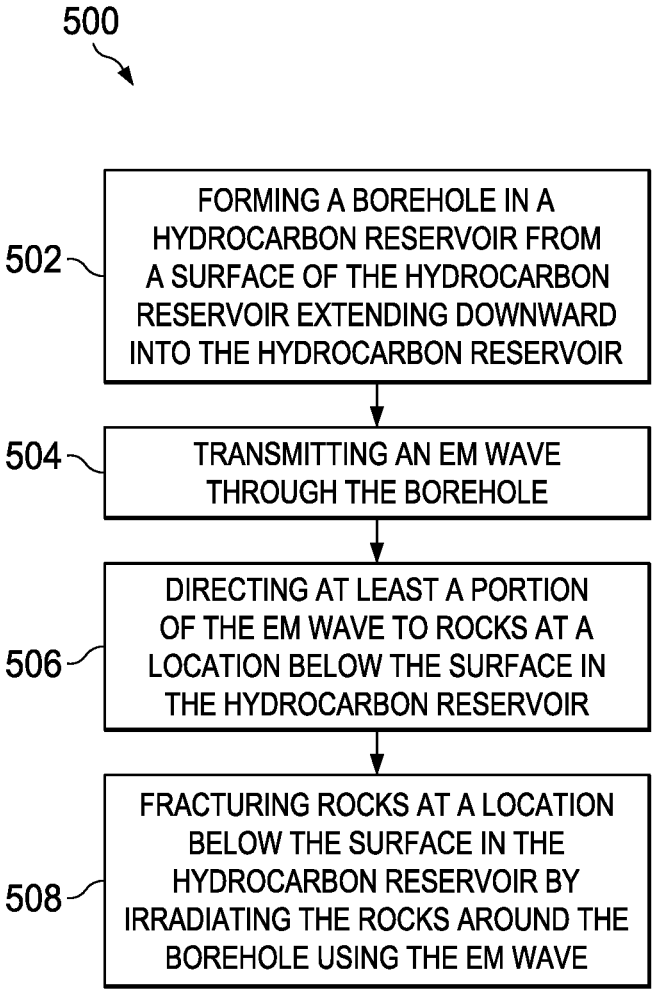
FIG. 5 illustrates an example method for fracturing rocks using electromagnetic waves according to an implementation.

FIG. 5 illustrates an example method 500 for fracturing rocks using EM waves according to an implementation. For clarity of presentation, the description that follows generally describes method 500 in the context of FIGS. 1A-1C, 2A-2B, 3, and 4A-4D.

At 502, a borehole is formed in a hydrocarbon reservoir. The borehole is formed from a surface of the hydrocarbon reservoir extending downward into the hydrocarbon reservoir. In some cases, a borehole is a first borehole, and multiple boreholes are formed in the hydrocarbon reservoir. The multiple boreholes include the first borehole. In some cases, the multiple boreholes include vertical boreholes. Alternatively or in combination, the multiple boreholes include horizontal boreholes. In some cases, the multiple boreholes formed a 5-spot pattern.

At 504, an EM wave that fractures rocks in the hydrocarbon reservoir is transmitted through the borehole. In some cases, the EM wave is generated using an EM wave transmitter. In some cases, the EM wave transmitter can be positioned at a surface of the reservoir. Alternatively, the EM wave transmitter can be positioned inside the boreholes. In some cases, the EM wave transmitter is configured to generate an EM wave having a frequency between 500 KHz and 5 MHz. Alternatively or in combination, the EM wave transmitter can be configured to generate EM waves up to 100 MHz. At 506, at least a portion of the EM wave is directed to rocks at a location below the surface in the hydrocarbon reservoir. At 508, the rocks at a location below the surface in the hydrocarbon reservoir are fractured by irradiation of the radio wave.

This description is presented to enable any person skilled in the art to make and use the disclosed subject matter, and is provided in the context of one or more particular implementations. Various modifications to the disclosed implementations will be readily apparent to those skilled in the art, and the general principles defined herein may be applied to other implementations and applications without departing from scope of the disclosure. Thus, the present disclosure is not intended to be limited to the described and/or illustrated implementations, but is to be accorded the widest scope consistent with the principles and features disclosed herein.

Accordingly, the previous description of example implementations does not define or constrain this disclosure. Other changes, substitutions, and alterations are also possible without departing from the spirit and scope of this disclosure.

What is claimed is:

1. A method, comprising:

forming a borehole pattern in a hydrocarbon reservoir from a surface of the hydrocarbon reservoir extending downward into the hydrocarbon reservoir, wherein the borehole pattern comprises a plurality of boreholes and the plurality of boreholes are formed in a horizontal well pattern; and for each of the plurality of boreholes:

transmitting an electromagnetic (EM) wave through the respective borehole;

directing at least a portion of the EM wave to rocks at a location below the surface in the hydrocarbon reservoir; and fracturing the rocks at the location below the surface in the hydrocarbon reservoir by irradiating the rocks around the respective borehole using at least the portion of the EM wave, wherein irradiating the rocks elevates pore-water pressure in the rocks causing fracturing of the rocks, and an azimuthal coverage of a stimulation zone generated by the EM wave for the respective boreholes is a fraction of a circumference of the respective borehole.

2. The method of claim 1, wherein the borehole pattern is a 5-spot pattern.

3. The method of claim 1, wherein the EM wave has a frequency between 500 KHz and 5 MHz.

4. The method of claim 1, wherein the rocks have a permeability between about 1 nanodarcy (nD) and 0.01 millidarcy (mD).

5. The method of claim 1, further comprising:

positioning an EM wave transmitter at a surface of the hydrocarbon reservoir; and generating the EM wave using the EM wave transmitter.

6. The method of claim 1, further comprising:

positioning an EM wave transmitter in at least one borehole of the plurality of boreholes, wherein the EM wave transmitter is enclosed in a protective case;

generating the EM wave using the EM wave transmitter; and retrieving the EM wave transmitter after the rocks are fractured.

7. The method of claim 1, wherein the location is a first location and the EM wave is a first EM wave, further comprising:

transmitting a second EM wave through at least one borehole of the plurality of boreholes;

directing at least a portion of the second EM wave to rocks at a second location below the surface in the hydrocarbon reservoir; and fracturing the rocks at the second location below the surface in the hydrocarbon reservoir by irradiating the rocks around the at least one borehole of the plurality of boreholes using at least the portion of the second EM wave, wherein irradiating the rocks elevates pore-water pressure in the rocks causing fracturing of the rocks, and a distance between the first location and the second location is determined based on a penetration depth of the first EM wave.

8. The method of claim 1, wherein a radiation pattern generated by the EM wave for each of the plurality of boreholes is azimuthally asymmetric with respect to the respective borehole.

9. The method of claim 1, wherein forming, in the hydrocarbon reservoir, the borehole pattern comprising:

determining a fracturing radius based on a stimulated fracture density; and positioning the plurality of boreholes in the borehole pattern based on the fracturing radius.

10. A method, comprising:

forming a borehole pattern comprising a plurality of boreholes in a hydrocarbon reservoir from a surface of the hydrocarbon reservoir extending downward into the hydrocarbon reservoir;

transmitting an EM wave through at least one of the plurality of boreholes; and for each of the at least one of the plurality of boreholes, fracturing rocks around the respective borehole using the EM wave, wherein an azimuthal coverage of a stimulation zone generated by the EM wave for each of the plurality of boreholes is a fraction of a circumference of the respective borehole.

11. The method of claim 10, wherein the plurality of boreholes are formed in a vertical well pattern.

12. The method of claim 10, wherein the plurality of boreholes are formed in a horizontal well pattern.

13. The method of claim 10, wherein a radiation pattern generated by the EM wave for each of the at least one of the plurality of boreholes is azimuthally asymmetric with respect to the respective borehole.

14. The method of claim 10, wherein the plurality of boreholes are positioned in a pattern having an equal distance between neighboring boreholes, wherein the equal distance is determined based on a stimulated fracture density.

15. The method of claim 10, further comprising:

positioning an EM wave transmitter at a surface of the hydrocarbon reservoir; and generating the EM wave using the EM wave transmitter.

16. The method of claim 10, further comprising:

positioning an EM wave transmitter in at least one of the plurality of the boreholes, wherein the EM wave transmitter is enclosed in a protective case;

generating the EM wave using the EM wave transmitter; and retrieving the EM wave transmitter after the rocks are fractured.

17. The method of claim 10, wherein the borehole pattern is a 5-spot pattern.

18. The method of claim 10, wherein the EM wave has a frequency between 500 KHz and 5 MHz.

* * * * *